US007150640B2

(12) United States Patent
Fukui et al.

(10) Patent No.: US 7,150,640 B2
(45) Date of Patent: Dec. 19, 2006

(54) LEVER TYPE CONNECTOR

(75) Inventors: Masayuki Fukui, Shizuoka (JP); Keisuke Nagao, Shizuoka (JP); Teruo Yokota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/398,753

(22) Filed: Apr. 6, 2006

(65) Prior Publication Data

US 2006/0228921 A1 Oct. 12, 2006

(30) Foreign Application Priority Data

Apr. 8, 2005 (JP) ..... 2005-111644
Apr. 8, 2005 (JP) ..... 2005-111645

(51) Int. Cl.
*H01R 13/62* (2006.01)

(52) U.S. Cl. ..... 439/157

(58) Field of Classification Search ..... 439/157, 439/466, 468, 473, 901
See application file for complete search history.

(56) References Cited

U.S. PATENT DOCUMENTS 5,681,175 A * 10/1997 Busse et al. ..... 439/157
6,705,881 B1 * 3/2004 Tsuchiya ..... 439/157
6,762,363 B1 * 7/2004 Yamashita et al. ..... 174/74 R
6,832,922 B1 * 12/2004 Kozono et al. ..... 439/135
7,052,293 B1 * 5/2006 Koshy et al. ..... 439/157
2005/0064749 A1 * 3/2005 Stella et al. ..... 439/157

FOREIGN PATENT DOCUMENTS

JP 2003-272768 9/2003

* cited by examiner

*Primary Examiner*—Tho D. Ta
(74) *Attorney, Agent, or Firm*—Armstrong, Kratz, Quintos, Hanson & Brooks, LLP

(57) ABSTRACT

The present invention is to provide a lever type connector to assure unlocking of a lever locking portion at a small size connector. The lever type connector has a cover having electric wire holder ribs at a rear surface of the cover. The electric wire holder ribs are disposed at a base portion of the lever locking portion and protrude downwardly from the rear surface of the cover so as to abut the electric wires. The electric wire holder ribs extend laterally to the electric wires and have a enough height to prevent the electric wires from interfering with a clearance, which allows the lever locking portion to move into the clearance. The clearance assured by the electric wire holder ribs ensures unlocking of the lever locking portion even when the electric wires occupy a large space in the connector.

6 Claims, 6 Drawing Sheets

LEVER TYPE CONNECTOR

BACKGROUND OF THE INVENTION

1. Field of the Invention

The present invention relates to a lever type connector having a connector housing for receiving a terminal of an electric wire, a cover attached to the connector housing for guiding and leading out the electric wire, and a lever attached to the connector housing.

2. Description of the Related Art

JP,2003-272768,A discloses a lever type connector. FIG. 8 is a partially sectional view of a conventional lever type connector. FIG. 9 is another partially sectional view of the lever type connector.

As shown in FIGS. 8 and 9, the lever type connector includes a box-shaped connector housing 60 for receiving a terminal of electric wires 4, a hemisphere cover 70 attached to an upper base plate of the connector housing 60 for guiding and leading out the electric wires 4, and a lever 80 attached to the connector housing 60 and sandwiching the connector housing 60 and cover 70. The plurality of the wires 4 come out upwardly from a cavity 63 and are guided horizontally with the hemisphere cover 70 and led outside the cover 70.

The connector housing 60 has an axle 66 at each side thereof for the lever 80 to rotate about the axles. The lever 80 has a guide hole 81, a rotation hole 86, recesses 82 at each side thereof, and an engaging portion 88. The lever 80 is rotatable about the axles 66 of the connector housing 60.

A mating connector (not shown) is fitted from an under side of the connector housing 60. Guide pins (not shown) disposed in the mating connector each are inserted into the guide hole 81 of the lever 80 and pulled upwardly as the lever 80 rotates so that the mating connector is fitted into the connector housing 60. After fitting, the lever locking portion 74 is locked to the engaging portion 88 of the lever 80 as shown in FIG. 8.

When the both connectors are unlocked to each other, a reverse operation of the above is carried out. For unlocking, the lever locking portion 74 is firstly depressed toward a direction B1 as shown in FIG. 9 and the engaging portion 88 of the lever 80 is moved along directions B2 and B3 so as to unlock the lever locking portion 74. The connector shown in FIGS. 8 and 9 is only an example to illustrate features of the connector having the cover and not a connector disclosed in JP,2003-272768,A.

In order to rotate the engaging portion 88 toward the directions B2 and B3, it is necessary to have a enough clearance CL' to accept a downward movement of the lever locking portion 74 as shown in FIG. 9.

A small size connector and cover 70 are recently requested so that the electric wires 4 occupy a large space in the connector and the connector can not have a enough space to keep the clearance CL'.

When the clearance CL' is not enough provided, the lever locking portion 74 interferes with the electric wires 4 so that it is difficult to depress enough the lever locking portion 74 toward the direction B1. Accordingly, it becomes also difficult to move the engaging portion 88 toward the directions B2 and B3 and the unlocking of the connectors becomes impossible.

SUMMARY OF THE INVENTION

The present invention is to provide a lever type connector for assuring unlocking of a lever with a lever locking portion and further preventing a cover from being pulled out of the connector housing.

According to a first aspect of the present invention, a lever type connector includes a connector housing for receiving a terminal of an electric wire; an extended wall disposed on an upper base plate of the connector housing; a cover to be slid inside the extended wall and attached to the connector housing, the cover guiding and leading out the electric wire; a lever rotatably attached to the connector housing; a lever locking portion disposed on a portion of the cover for engaging with a part of the lever, said locking portion being flexible and arm shaped; a locking protrusion disposed on the cover for locking the cover to the connector housing; and an engaging portion disposed on the connector housing for engaging with the locking protrusion, wherein the cover has an electric wire holder rib disposed at and protruding from a rear surface of the cover and abutting to the electric wire so as to prevent the electric wire from interfering with a clearance, which allows a downward movement of the lever locking portion.

Preferably, the electric wire holder ribs are disposed in the vicinities of a free end and fixed ends of the lever locking portion.

Preferably, the cover has a stopper protrusion disposed on a side wall of the cover and faced to the extended wall for preventing the side wall of the cover at an electric wire outlet from expanding outwardly and preventing the locking protrusion and engaging portion from being unlocked to each other.

Preferably, the stopper protrusion is disposed more closely to the electric wire outlet than the locking protrusions and engaging portions.

Preferably, the stopper protrusion has a slope extending obliquely upwardly to the extended wall of the cover in a direction of the electric wire outlet.

Preferably, the cover has a jig insertion hole, which is formed by cutting out a lower portion of the cover, disposed between the stopper protrusion and the locking protrusion for inserting a jig to detach the cover from the connector housing.

DETAILED DESCRIPTION OF THE PREFERRED EMBODIMENTS

Embodiments of the present invention are explained by referring to drawings.

Figure 1:
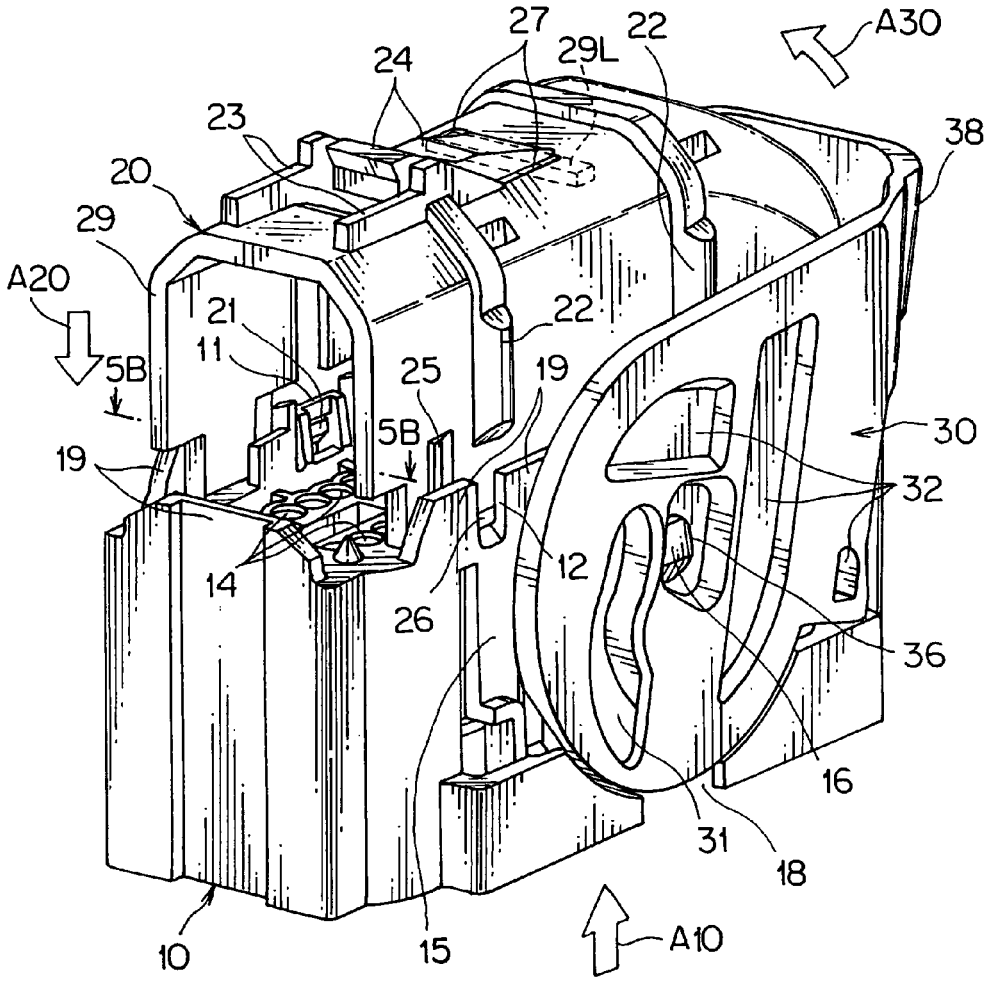
FIG. 1 is a perspective view showing an embodiment of a lever type connector of the present invention.
Figure 4:
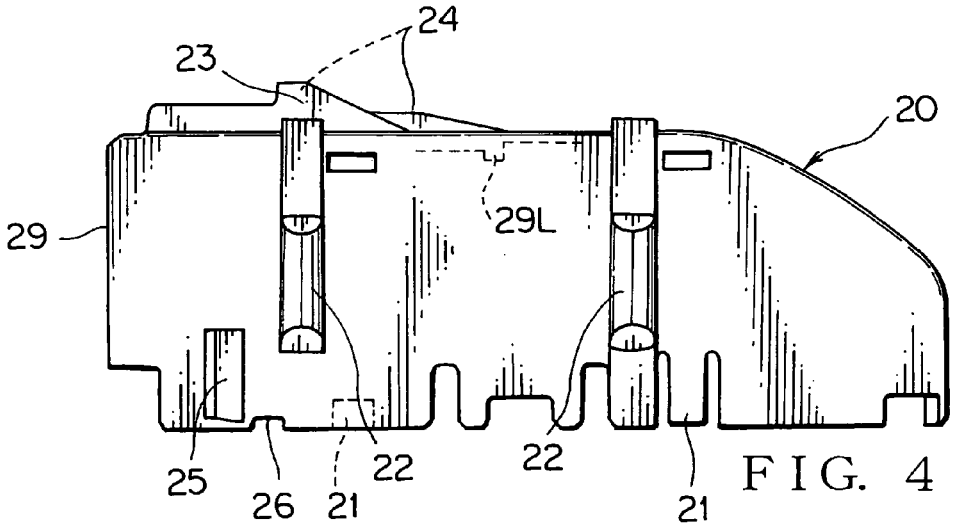
FIG. 4 is a side view of the cover of FIG. 1.

FIG. 1 shows an embodiment of a lever type connector of the present invention. The lever type connector includes a connector housing 10 receiving terminals of electric wires, a cover 20 attached to the connector housing 10 and guiding and leading out the electric wires, and a lever 30 rotatably attached to the connector housing 10. The connector housing 10, the cover 20 and the lever 30 are formed by a resin such as PBT (polybutylene terephthalate).

The connector housing 10 is covered with the cover 20 in a direction A20 in FIG. 1. A mating connector (not shown) is fitted into the connector housing 10 in a direction A10. When the mating connector is fitted to the connector housing 10, guide pins (not shown) of the mating connector are fitted into guide holes 31 and moved upwardly as the lever 30 is rotated toward a direction A30 and the both connectors are fitted together. A locking operation between the lever 30 and cover 20 is explained later by referring to FIGS. 6 and 7.

Figure 2:
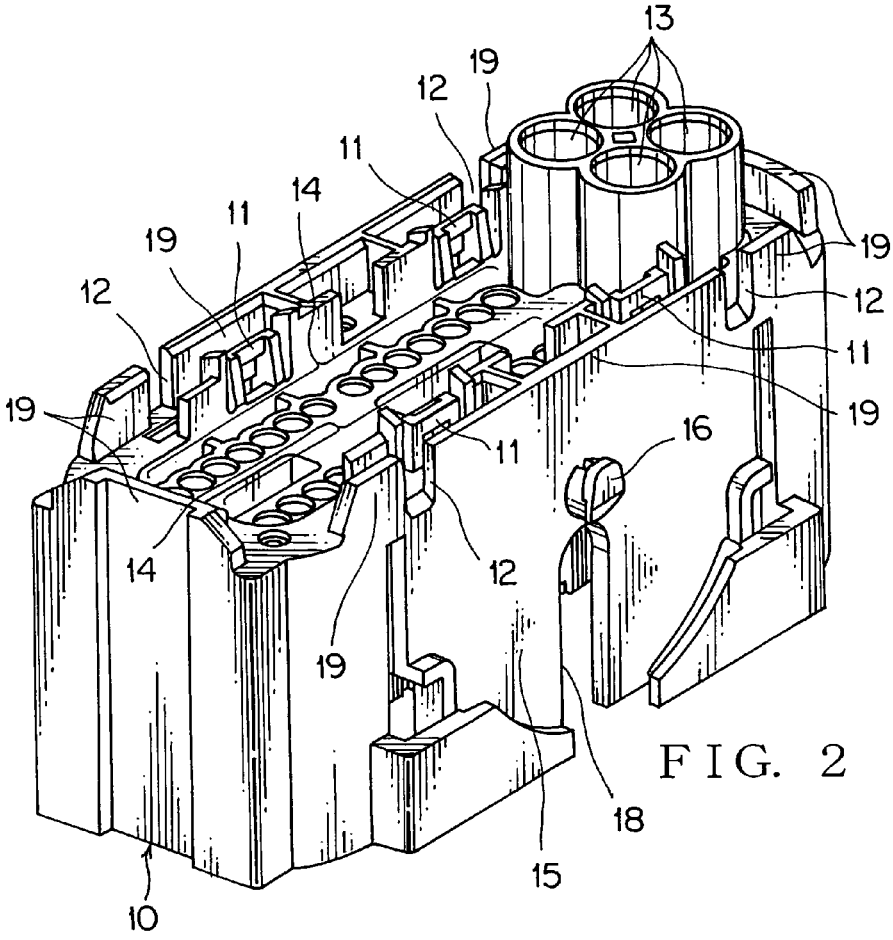
FIG. 2 is a perspective view showing a connector housing of FIG. 1.

As shown in FIGS. 1 and 2, the connector housing 10 has a box shape. A plurality of large cylindrical and small circular cavities 13 and 14, which receive the terminals of the electric wires, are disposed on an upper base plate of the connector housing 10. The large and small cavities 13 and 14 each lead out a large and small size electric wire, respectively. Extended walls 19 are disposed at an edge of the upper base plate along a longitudinal direction of the connector housing 10 and opposed to each other. The extended walls 19 are extensions of side walls of the connector housing 10. Slits 12 are formed in the extended walls 19.

The connector housing 10 has a plurality of engaging portions 11, which engage with locking protrusions 21 of the cover 20, disposed inside the extended walls 19. The engaging portions 11 accept the locking protrusions 21 from outside to inside. Shape and number of the engaging portions 11 correspond to those of the locking protrusions 21.

Both side walls of the connector housing 10 serve as attachment surfaces 15 for the lever 30. FIGS. 1 and 2 show only one side. A axle 16 and guide groove 18 for the lever 30 are disposed on each attachment surface 15.

As shown in FIG. 1 and FIGS. 3–5, the cover 20 is dome-shaped and has an electric wire outlet 29 and a lower opening. The cover 20 is attached to the connector housing 10 by placing outer surface of the cover 20 facing to inner surfaces of the extended walls 19. After setting the cover 20 to the upper base plate, the electric wires are lead out through the electric wire outlet 29.

Figure 3:
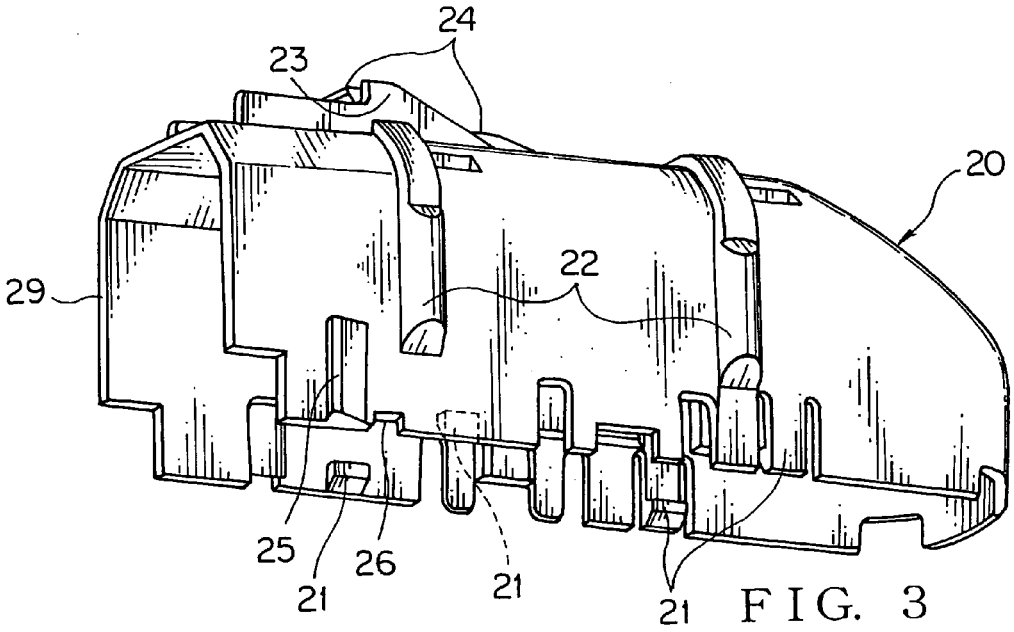
FIG. 3 is a perspective view of a cover of FIG. 1 when viewed from obliquely downwardly.

As shown in FIGS. 3 and 5, the cover 20 has two pairs of locking protrusions 21 on an inner wall thereof to fix the connector housing 10. Each pair of the locking protrusions 21 are opposed to each other and have claws to enter from outside and engage with the engaging portions 11.

A plurality of ribs 22 are disposed on both side walls of the cover 20 and extend along the attaching direction A20 of the cover 20. Stopper protrusions 25 are disposed on both side walls of the cover 20 and faced to the extended walls 19 to prevent the side walls of the cover 20 from expanding outwardly and prevent the locking protrusions 21 and engaging portions 11 from being unlocked to each other. As shown in FIGS. 1, 3 and 5, the stopper protrusions 25 have slopes extending obliquely upwardly to the extended walls 19 of the cover 20 in a direction of the electric wire outlet 29. The stopper protrusions 25 have tops at a side of the electric wire outlet 29. The stopper protrusions 25 are disposed more closely to the electric wire outlet 29 than the locking protrusions 21 and engaging portions 11.

Figure 5A:
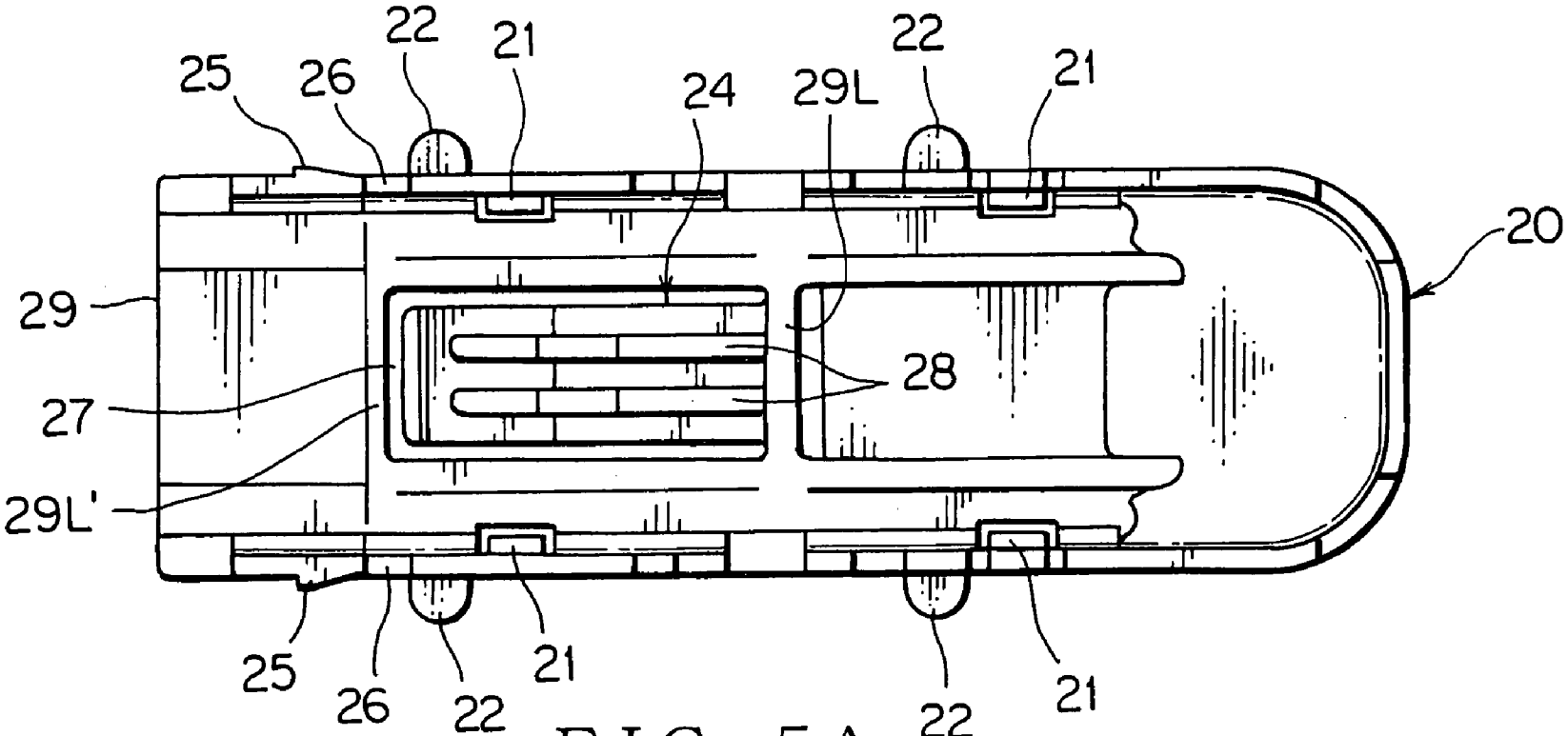
FIG. 5A is a rear view of the cover of FIG. 1.
Figure 5B:
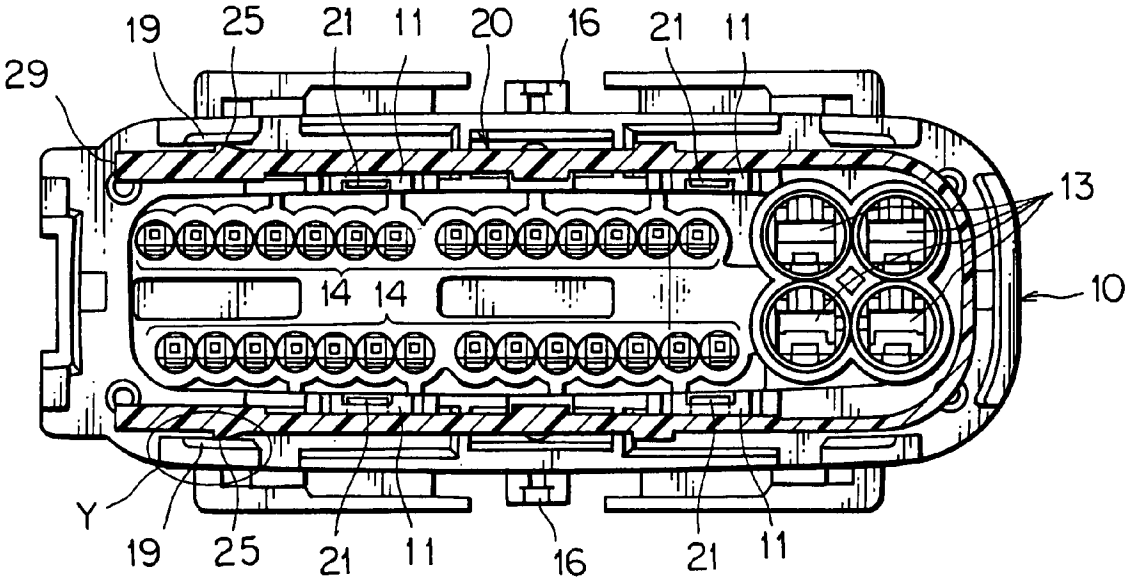
FIG. 5B is a sectional view taken along a line 5B—5B of FIG. 1.
Figure 5C:
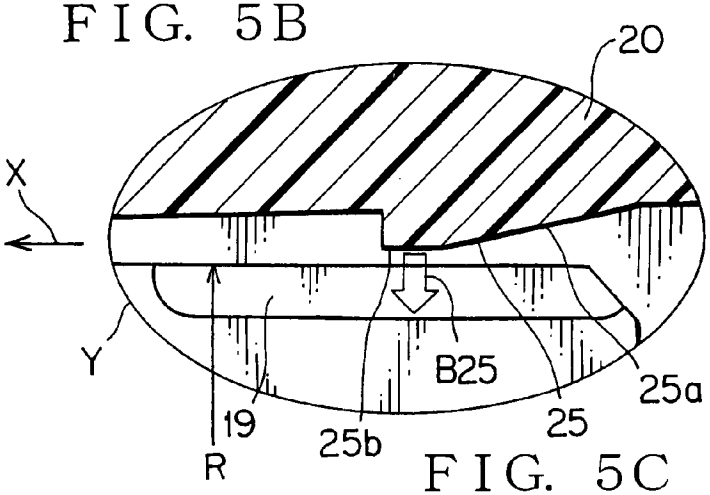
FIG. 5C is a partially expanded view of Y of FIG. 5B.

FIG. 5B is a sectional view taken along a line 5B—5B of FIG. 1 and FIG. 5C is a partially expanded view of Y of FIG. 5B.

When the electric wires 4 are pulled toward a detaching direction of the cover 20, the electric wire outlet 29 tends to stretch in a direction B25 of FIG. 5C. Accordingly, the stopper protrusions 25 abut to the extended walls 19 so that the cover 20 does not stretch further and the engagement of the locking protrusions 21 and engaging portions 11 is retained.

Since the stopper protrusions 25 are disposed more closely to the electric wire outlet 29 than the locking protrusions 21 and engaging portions 11, the lower portion of the cover 20 does not stretch so that the cover 20 is not easily detached from the connector housing 10.

The extended walls 19 have a curvature R so as to approach gradually to the stopper protrusions 25 toward the electric wire outlet 29, or a direction X of FIG. 5C. A distance between the stopper protrusions 25 and extended walls 19 becomes shorter so that the stretching of the cover 20 is further effectively prevented.

The stopper protrusions 25 are effective for retaining the cover 20 regardless of the lever 30.

As shown in FIGS. 1, 3, 4 and 5, jig insertion holes 26 are formed by cutting out lower portions of the cover 20 and are disposed between the stopper protrusions 25 and the locking protrusions 21 for inserting a jig to detach the cover 20 from the connector housing 10. When the jig is inserted into the jig insertion holes 26, the cover 20 is easily detached from the connector housing 10 since the stopper protrusions 25 are not subjected to a large force.

As shown in FIGS. 1, 3, 4 and 5, a lever locking portion 24 is disposed on an upper surface of the cover 20 to be locked to a cover engaging portion 38 and has a flexible arm shape. Side members 23 are disposed to sandwich the lever locking portion 24 and a U-shaped slit 27 is disposed to surround a part of the lever locking portion 24 as shown in FIG. 5A so as to keep the flexibility thereof. As shown in FIG. 5A, reinforcing ribs 28 are disposed on a rear surface of the lever locking portion 24. The cover 20 has a curved portion at an opposite side of the electric wire outlet 29 so as to bend the electric wires gently.

Figure 6:
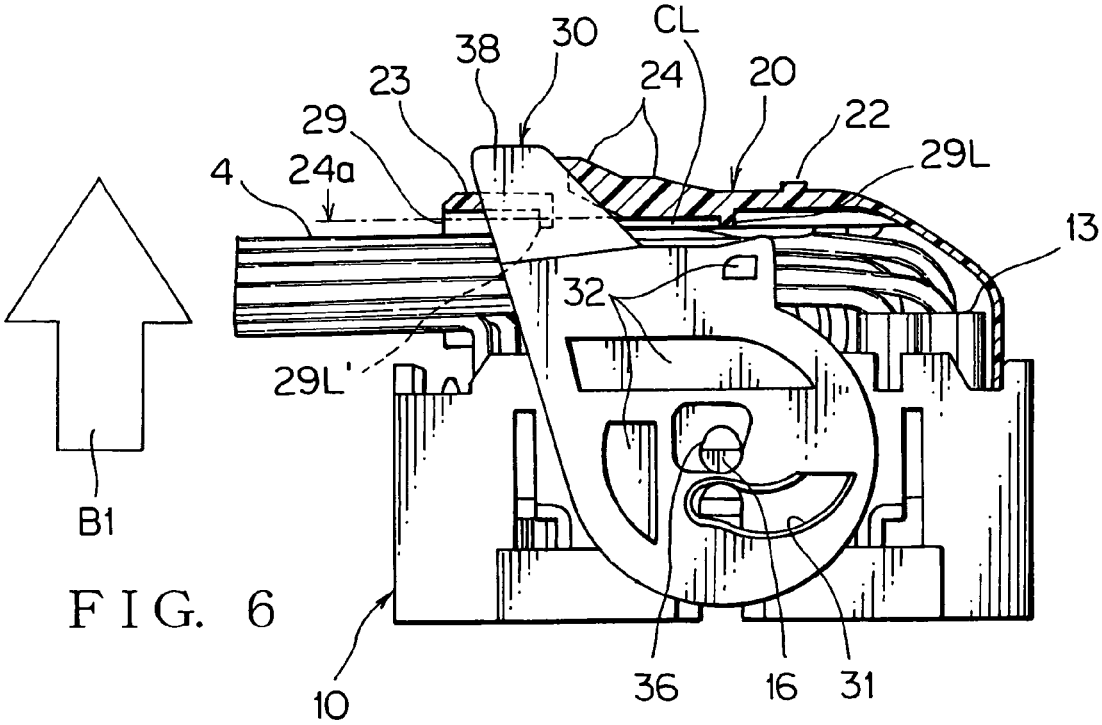
FIG. 6 is a partially sectional view of the embodiment of the lever type connector.

As shown in FIG. 6, electric wire holder ribs 29L and 29L' are disposed at the vicinities of a fixed end and a free end of the lever locking portion 24, respectively on the rear surface of the cover 20, and protrude downwardly from a base surface 24*a* of the lever locking portion 24. The electric wire holder ribs 29L and 29L' protrude to abut the electric wires 4 and extend laterally to the electric wires 4. The electric wire holder ribs 29L and 29L' have a enough height so as to prevent the electric wires 4 from interfering with a clearance CL, which allows a downward movement of the lever locking portion 24. Accordingly, even the electric wires 4 occupy a large space in the cover 20, the clearance CL is assuredly kept so that the lever locking portion 24 is assuredly unlocked.

The lever 30 is attached to sandwich the attachment surfaces 15 of the connector housing 10. The lever 30 has, at each attachment surface 15, a rotation hole 36 at the center thereof, the guide hole 31 around the rotation hole 36, and recesses 32. The rotation holes 36 and axles 16 are fitted together so that the lever 30 is rotatable about the axles 16. The lever 30 has the cover engaging portion 38 to be engaged with the lever locking portion 24 of the cover 20.

Figure 7:
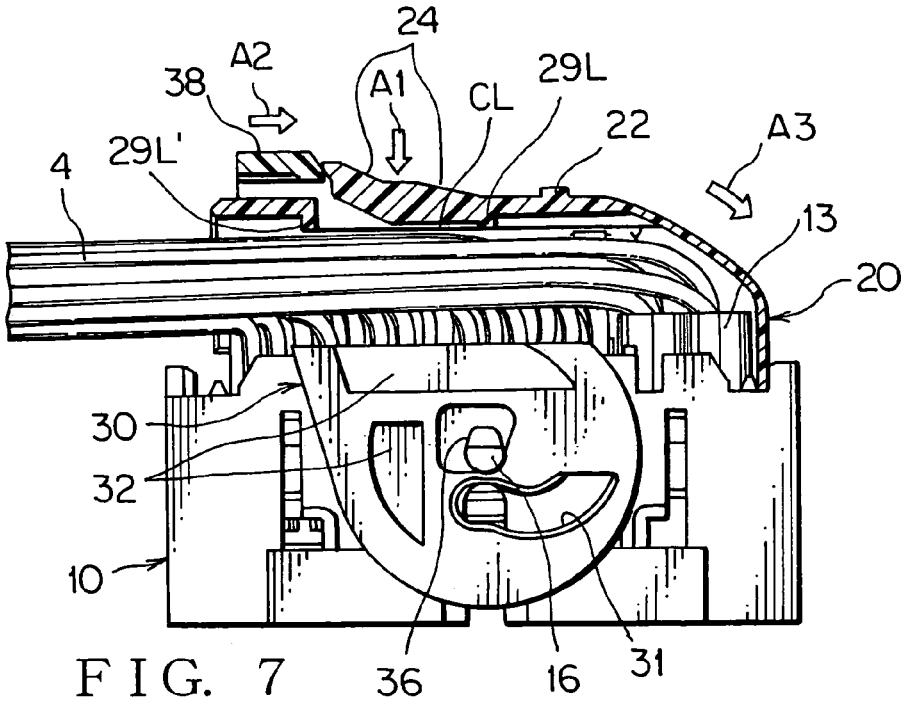
FIG. 7 is another partially sectional view of the lever type connector of FIG. 6.
Figure 8:
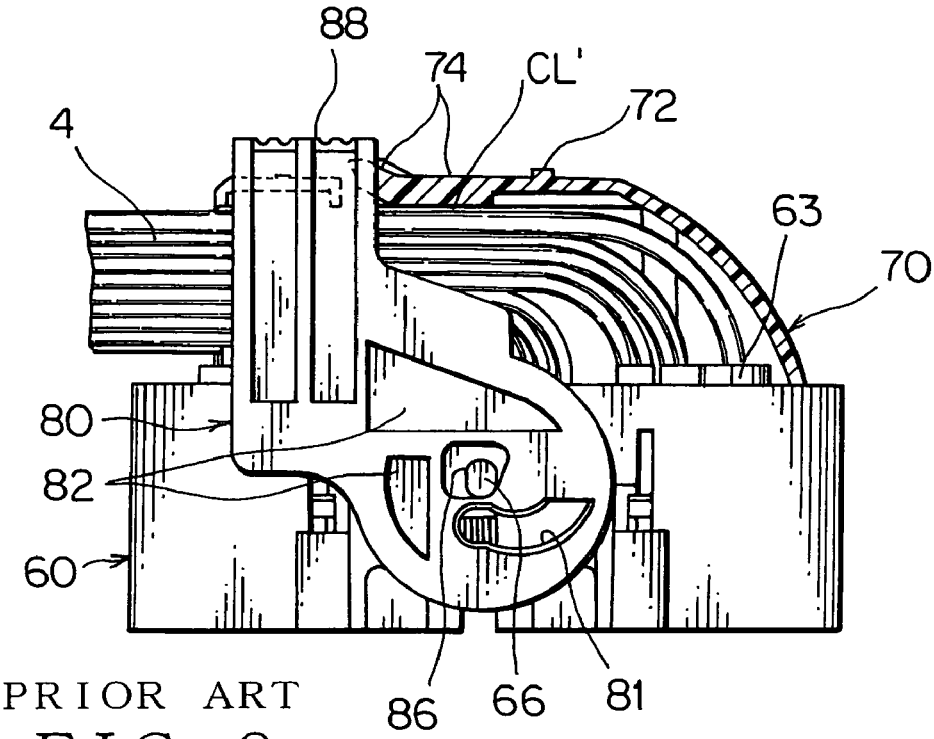
PRIOR ART FIG. 8
FIG. 8 is a partially sectional view of a conventional lever type connector.
Figure 9:
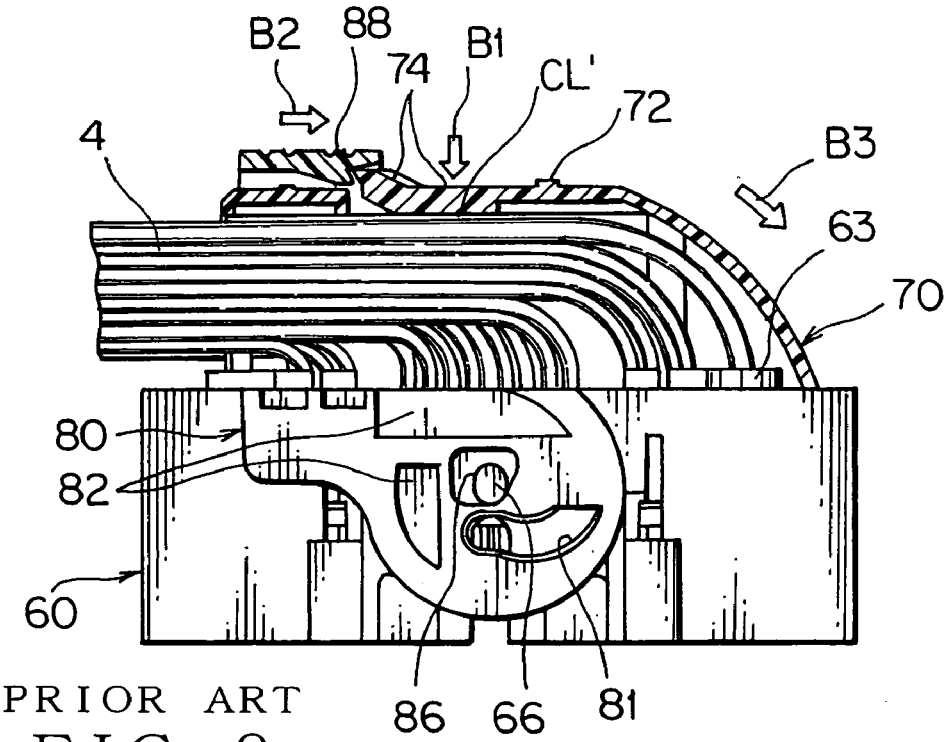
PRIOR ART FIG. 9
FIG. 9 is another partially sectional view of the lever type connector of FIG. 8.

FIGS. 6 and 7 show how to engage and unlock the lever 30. FIG. 6 is a partially sectional view of the lever type connector of the embodiment. FIG. 7 is another partially sectional view of the lever type connector.

When the cover 20 is fitted into the connector housing 10, the cover 20 is slid on the inner surfaces of the extended walls 19 toward the direction A20 of FIG. 1 and abutted to the upper base plate of the connector housing 10. The locking protrusions 21 of the cover 20 engage to the engaging portions 11 of the connector housing 10. The mating connector (not shown) is fitted into the lower portion of the connector housing 10 from the direction A10 of FIG. 1. Then, the guide pins (not shown) of the mating connector are inserted into the guide holes 31. When the lever 30 is rotated into the direction A30 of FIG. 1, the guide pins are moved upwardly so that the mating connector is fitted into the connector housing 10. The lever locking portions 24 are locked to the cover engaging portion 38 of the lever 30 so that the connector housing 10 and mating connector are fitted together.

For unlocking, the lever locking portion 24 of FIG. 7 is depressed downwardly to the direction A1 so as to unlock the engagement with the cover engaging portion 38. When the lever 30 is rotated into a direction A3 of FIG. 7, the connector housing 10 is disengaged from the mating connector. As described above, the clearance CL is assuredly kept between the lower surface of the lever locking portion 24 and the electric wires 4 with the electric wire holder ribs 29L and 29L' so that the lever locking portion 24 is depressed without the interference of the electric wires and the lever 30 is assuredly disengaged.

According to the embodiment of the present invention, the electric wire holder ribs 29L and 29L' protruded from the rear surface of the cover 20 keep the clearance CL for allowing the downward movement of the lever locking portion 24 so that the lever locking portion 24 and the cover engaging portion 38 are assuredly disengaged each other without the interference of the electric wires 4 occupying the large space in the connector. Thus, the connector can be smaller by keeping the electric wires to the same amount.

What is claimed is:

1. A lever type connector comprising:

a connector housing for receiving a terminal of an electric wire;

an extended wall disposed on an upper base plate of the connector housing;

a cover to be slid inside the extended wall and attached to the connector housing, the cover guiding and leading out the electric wire;

a lever rotatably attached to the connector housing;

a lever locking portion disposed on a portion of the cover for engaging with a part of the lever, said locking portion being flexible and arm shaped;

a locking protrusion disposed on the cover for locking the cover to the connector housing; and an engaging portion disposed on the connector housing for engaging with the locking protrusion, wherein said cover has an electric wire holder rib disposed at and protruding from a rear surface of the cover and abutting to the electric wire so as to prevent the electric wire from interfering with a clearance, which allows a downward movement of the lever locking portion.

2. The lever type connector as claimed in claim 1, wherein said electric wire holder ribs are disposed in the vicinities of a free end and fixed ends of the lever locking portion.

3. The lever type connector as claimed in claim 1, wherein said cover has a stopper protrusion disposed on a side wall of the cover and faced to the extended wall for preventing the side wall of the cover at an electric wire outlet from expanding outwardly and preventing the locking protrusion and engaging portion from being unlocked to each other.

4. The lever type connector as claimed in claim 3, wherein said stopper protrusion is disposed more closely to the electric wire outlet than the locking protrusion and engaging portion.

5. The lever type connector as claimed in claim 4, wherein the stopper protrusion has a slope extending obliquely upwardly to the extended wall of the cover in a direction of the electric wire outlet.

6. The lever type connector as claimed in claim 5, wherein said cover has a jig insertion hole, which is formed by cutting out a lower portion of the cover, disposed between the stopper protrusion and the locking protrusion for inserting a jig to detach the cover from the connector housing.

* * * * *